US005799943A

United States Patent [19]

Morgan

[11] Patent Number: 5,799,943

[45] Date of Patent: Sep. 1, 1998

[54] THREE-DIMENSIONAL WORD GAME

[76] Inventor: Jeffrey D. Morgan, 832 Wilkinson St., Shreveport, La. 71104

[21] Appl. No.: 439,484

[22] Filed: May 11, 1995

[51] Int. Cl.[6] ..... A63F 3/00

[52] U.S. Cl. ..... 273/272; 273/241; 273/282.1; 273/282.3; 273/160

[58] Field of Search ..... 273/236, 241, 273/272, 282.1, 282.3, 153 R, 156, 160

[56] References Cited

U.S. PATENT DOCUMENTS

| | | | |
|---|---|---|---|
| 176,144 | 4/1876 | McDougall | 273/272 X |
| 2,886,325 | 5/1959 | Long | 273/157 |
| 3,481,603 | 12/1969 | Sugden | 273/241 X |
| 3,692,310 | 9/1972 | Martin | 273/131 |
| 3,751,039 | 8/1973 | Oykoski | 273/131 |
| 3,827,695 | 8/1974 | Hess | 206/46 |
| 3,930,651 | 1/1976 | Rader | 273/135 D |
| 3,993,313 | 11/1976 | Tillotson | 273/241 X |
| 4,019,743 | 4/1977 | Castanis | 273/135 D |
| 4,165,077 | 8/1979 | Falcione | 273/239 |
| 4,280,703 | 7/1981 | Slone | 273/241 |
| 4,438,932 | 3/1984 | Finkel | 273/237 |
| 4,552,363 | 11/1985 | Rehkemper et al. | 273/241 |
| 4,776,597 | 10/1988 | Rudell | 273/241 |
| 4,955,615 | 9/1990 | Eck | 273/241 |
| 5,048,840 | 9/1991 | Johnson, Jr. | 273/241 |
| 5,251,900 | 10/1993 | Gallant | 273/160 X |
| 5,314,192 | 5/1994 | Broudy et al. | 273/282.3 |
| 5,337,501 | 8/1994 | Amanze | 273/272 X |

FOREIGN PATENT DOCUMENTS

| | | | |
|---|---|---|---|
| 0161840 | 4/1985 | European Pat. Off. | A63F 3/04 |
| 9317767 | 9/1993 | WIPO | 273/272 |

*Primary Examiner*—William E. Stoll
*Attorney, Agent, or Firm*—John M. Harrison

[57] ABSTRACT

A three-dimensional word game which is characterized by a base having a grid with one or more squares, selected ones of which are fitted with openings or projections for receiving and anchoring correspondingly-shaped, lettered blocks to facilitate vertical stacking and horizontal extension of the blocks together and spelling words. In a preferred embodiment, the blocks (typically cubes) are designed to connect by such elements as round and truncated pegs, snap flanges, threaded posts and internally-threaded post seats, dovetail slots and tabs, as well as by magnetic attraction. The blocks are typically provided with letters of the alphabet located on at least one side, to facilitate selectively connecting or interlocking the blocks, both vertically and horizontally, to spell words during progression of the game.

19 Claims, 3 Drawing Sheets

FIG. 8
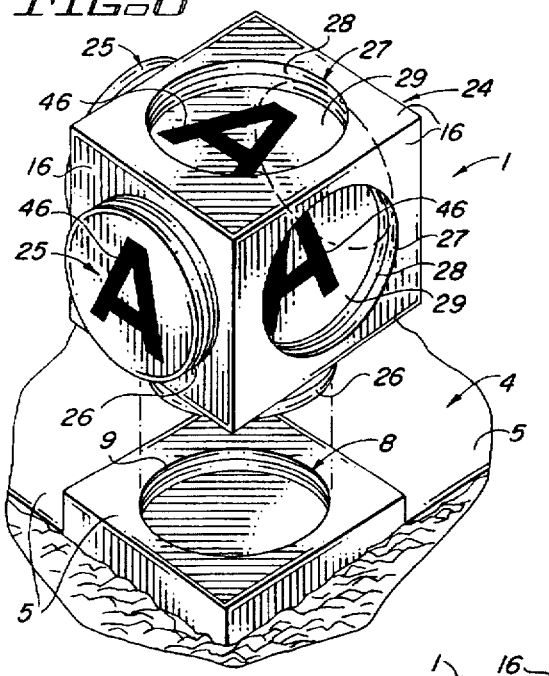
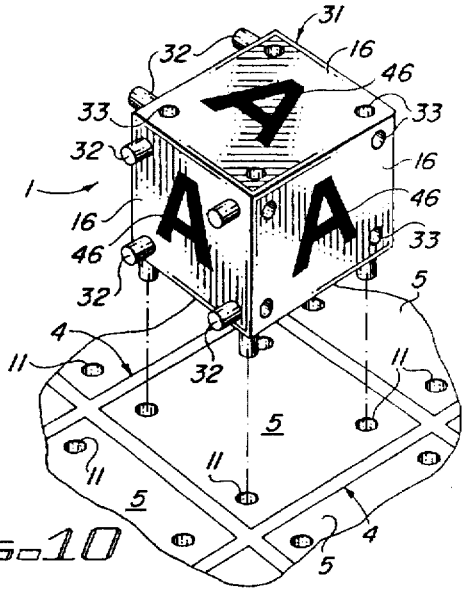
FIG. 10
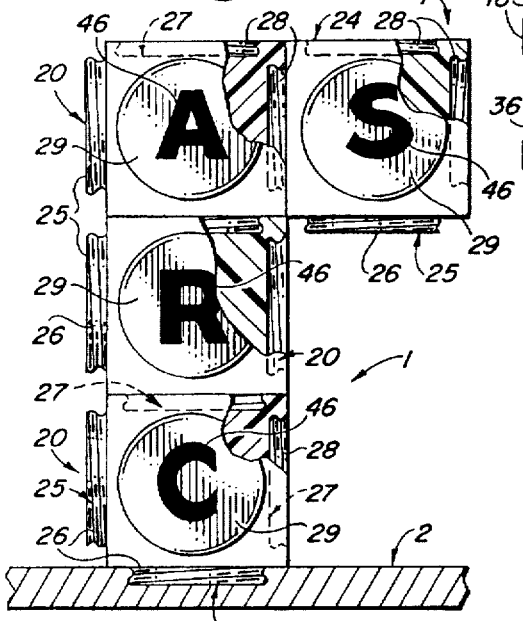
FIG. 9
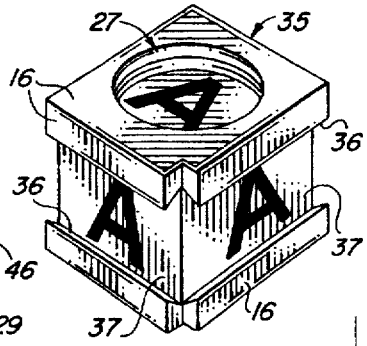
FIG. 11
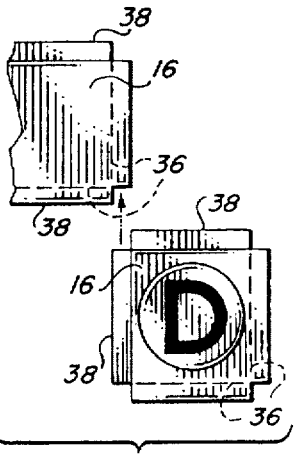
FIG. 12
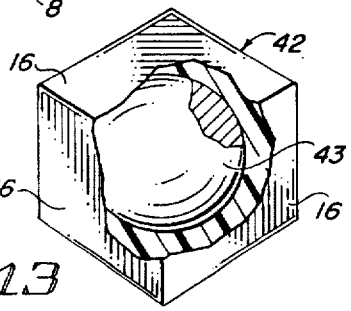
FIG. 13
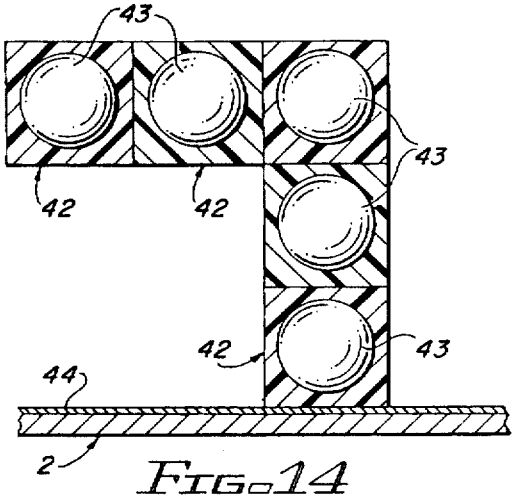
FIG. 14

THREE-DIMENSIONAL WORD GAME

BACKGROUND OF THE INVENTION

1. Field of the Invention

This invention relates to word games, and more particularly, to a three-dimensional word game which utilizes a base having a grid defining discreet spaces, typically provided with slots, openings and/or projections for receiving and anchoring correspondingly-shaped blocks, typically cubes provided with one or more letters. The blocks may be initially stacked vertically and subsequently interlocked horizontally to spell words both horizontally and vertically during the progression of the game. Interlocking of the blocks may typically be effected by means of pegs, both round and truncated, interlocking snap flanges, threaded posts with corresponding internally threaded sockets, dovetail slot and tab connecting elements and magnetic elements inserted in or on the blocks, in non-exclusive particular.

Word games have long been popular with people of all ages. Perhaps the best known word game is the game of "Scrabble", in which blocks imprinted with the letters of the alphabet are selectively positioned end-to-end on a game board or table to spell words. The game not only provides an interesting and educational pasttime but also serves to significantly increase the vocabularies of the players. In a typical game situation, the "Scrabble" blocks are imprinted on the top surface thereof with a letter of the alphabet and each player collects a certain number of blocks at random. The players then facilitate spelling of words in turn, by positioning the blocks on a flat surface in end-to-end relationship. Accordingly, the game is played in a single plane.

2. Description of the Prior Art

Various three-dimensional, stacked word games are known in the art. Typical of these is the game detailed in European Patent Application No. 0,161,840, which details a series of lettered cubes having an aperture in the center of each side, for receiving connecting pegs to facilitate connecting the cubes and forming words using letters along the adjacent sides of the cubes. Each peg is of sufficient length that adjacent sides of the adjacent cubes are in contact when an end of each peg is completely received in the aperture of the corresponding cube. An early U.S. Pat. No. 176,144, dated Apr. 18, 1876, to McDougall, details a "Combined Alphabet and Building-Blocks and Game Board" which includes multiple cubes, each having a peg and multiple holes, with a letter imprinted on one surface thereof. The cubes are interconnected using the pegs and holes, to spell words. A "Three-Dimensional Crossword Puzzle" is detailed in U.S. Pat. No. 2,886,325, dated May 12, 1959, to H. M. Long. The puzzle includes multiple cubes designed such that the face of each cube has a letter of the alphabet, to facilitate arranging the cubes in layers according to selected designations for aiding in the solution of a puzzle. U.S. Pat. No. 3,751,039, dated Aug. 7, 1973, to Walter J. Dykoski, details a "Three-Dimensional Board Game Apparatus". The apparatus includes a game board having an 8×8 array of square playing positions. Each playing position is provided with a peg hole centrally thereof to accommodate a support peg of the game piece. The game pieces include transparent plastic bodies with vertically-depending support pegs to permit the game pieces to be removably disposed in the peg holes of the game board and moved from one playing position to the other. Each game piece is also provided with at least one peg opening or hole to permit respective game pieces to be stacked on top of each other. U.S. Pat. No. 4,280,703, dated Jul. 28, 1981, to Keith W. Slone, details a "Three Dimensional Game With Political Theme". The game is played by two people and includes a three-colored game board divided into squares such that three dimensional play is involved. A combination of chess and checker moves is employed for the game pieces in the "Apparatus For Electronic Word Game" detailed in U.S. Pat. No. 4,438,932, dated Mar. 27, 1984, to Finkel. The apparatus includes a word game in which is displayed a word selected by the actuation of letter keys by a player. Also displayed is a pictorial illustration of the anatomy of a person on a gallows. The select word is blanked out so is not to be observed by another player, although the player can observe the number of letters in the selected word. The other player selects letters to arrive at the spelling of the selected word. U.S. Pat. No. 5,048,840, dated Sep. 17, 1991, to Albert L. Johnson, Jr., details a "Gameboard Building Apparatus". The apparatus is constructed of a game board adapted to allow stacking of pieces which are assembled thereon, including top pieces, that are frictionally interlockable onto the game board and with each other. The game board includes multiple adjacent game board or playing position squares arranged in an equilateral matrix and divided into equal sections. The squares include vertical walls for frictionally interlocking with complimenting vertical walls of stacked pieces, including top pieces. The stacking pieces have on one end an interlocking male wall and on the other, interlocking female walls, whereby the stacking pieces are adapted to frictionally interlock with complimenting vertical walls of the game board and each other. A "Board Game Apparatus" is detailed in U.S. Pat. No. 3,692,310, dated Sep. 19, 1972, to Ernest B. W. Martin. The invention includes a playing surface having multiple units which are each adapted for random assembly relative to the others to form a playing surface of undetermined shape before commencement of the game. The units are capable of manipulation into different mutual special relationships during a game in which the apparatus is used, such that the shape and arrangement of the playing surface can be altered. The units have valued designation markings of different respective values and at least two tokens are positionable on any one of the game units. U.S. Pat. No. 3,827,695, dated Aug. 6, 1974, to Roy P. Hess, details a "Three-Dimensional Vertical Stacking Domino Game Apparatus". The game includes multiple dominos, each of which has a body with one end face for abutting, stacking engagement with the face of another domino. Indicia markings are provided on at least two marked faces of the domino which are perpendicular to the one end face. The indicia identify two portions of each of the marked faces for use in playing the game. The body also has a second end face opposite to the one end face and perpendicular to the marked faces having indicia thereon and third and fourth faces which are perpendicular to the first and second end faces. Selected dominos are stacked with matching adjacent indicia on each domino. U.S. Pat. No. 3,930,651, dated Jan. 6, 1976, to James E. Rader, details a "Three Dimensional Word Game". The game includes a 3×3×3 cube for receiving letter pieces, there being twenty-six letter-receiving spaces disposed on the surface of the cubes, wherein one letter of the alphabet may be associated with each of the twenty-six letter pieces. To play in the game, players take turns placing one or more letter pieces onto the cubes and words are spelled out by tracing a path between consecutively adjacent letter pieces to determine the winner of the game. U.S. Pat. No. 4,019,743, dated Apr. 26, 1977, to George Castanis, details an "Edifice for Playing A Word Game". The multi-level edifice includes a set of transparent platforms supported one above the other by corner posts. Each platform includes a uniform array of playing sites equal in number to the square of a fixed number, some sites being "free". The remaining sites are adapted to accept playing chips bearing different letters associated with numerals representing different point values. Words are formed in a straight line on any platform level or levels on the playing surfaces. A "Word Game" is detailed in U.S. Pat. No. 4,165,077, dated Aug. 21, 1979, to Ronald D. Falcione. The word game includes multiple tiles and a tile support apparatus having an intersecting pattern of at least one row and at least one row of tile-receiving spaces. The object of the game is to determine the word combinations chosen by the other players to fill their tile supports. A "Game Board and Playing Pieces" is detailed in U.S. Pat. No. 4,776,597, dated Oct. 11, 1988, to Elliott A. Rudell. The game details a game board having playing pieces in which the game board is provided with multiple, square bosses arranged in a waffle pattern. The playing pieces are each provided with a peripheral skirt about the lower edge and an offset shoulder about the upper edge thereof. The bosses and playing pieces are square so that the playing pieces can be stacked on a respective boss of the board and on each other. U.S. Pat. No. 955,615, dated Sep. 11, 1990, to Eck, details "Hexagonal Game Tiles". The set of hexagonal playing pieces have a beehive shape when placed side by side to create a base for successive interlocking levels of play. Each player attempts to place his tiles in the most strategic and advantageous playing position.

It is an object of this invention to provide a threedimensional word game which is characterized by a base of substantially any shape and dimension, a grid shaped in the base, with raised or flat individual spaces formed by the grid and slots and openings or projections provided on all or selected spaces, for receiving correspondingly-shaped blocks fitted with letters or other insigma or indicia for matching, spelling or otherwise coordinating letters to form words or coordinating the other indicia as the blocks are stacked vertically on the grid and interlocked horizontally with respect to the game board.

Another object of this invention is to provide a three-dimensional word game which includes a game board of selected size and shape, at least a portion of which game board is provided with a grid layout defining individual squares, each fitted with recesses, holes, slots or projections of selected shape, for stacking corresponding lettered or marked blocks or cubes and interlocking the blocks or cubes in both stacked and vertical, as well as horizontal, relationship to spell words or coordinate indicia provided on the blocks.

Yet another object of this invention is to provide a new and improved three-dimensional game board characterized by a base of selected size and proportion, a grid provided on at least a portion of the base, the grid typically defining squares having one or more slots, holes, recesses or projections for receiving and mounting correspondingly shaped blocks, typically cubes, that interlock both vertically and horizontally by means of round or truncated pegs and truncated openings, snap flanges and flange receptacles, threaded posts and corresponding internal threaded recesses, dovetail slots and tabs or by means of magnets, to spell words or organize indicia provided on the cubes according to the rules of the game.

SUMMARY OF THE INVENTION

These and other objects of the invention are provided in a new and improved three-dimensional word game which is characterized in a preferred embodiment by an irregularly-shaped base provided with a grid which defines multiple squares, selected squares of which may be elevated and provided with slots, threaded or unthreaded openings and/or projections for receiving correspondingly-shaped building blocks such as cubes, and facilitate vertical stacking and horizontal interlocking of the cubes, the cubes having letters thereon to allow spelling of words both vertically and horizontally, as the cubes are interconnected. In a most preferrred embodiment the building cubes are characterized by truncated peg blocks, snap flange blocks, threaded post blocks, multiple round peg blocks, dovetail slotted and tab blocks and/or magnetic blocks, to facilitate the interlocking relationship.

BRIEF DESCRIPTION OF THE DRAWINGS

The invention will be better understood by reference to the accompanying drawings, wherein:

FIG. 8 is a perspective, exploded view of a threaded post block positioned for insertion of a threaded post in a corresponding internally-threaded space opening located in one of the grid spaces of the base;

FIG. 9 is a side view, partially in section, of four of the threaded post blocks threadably interlocked in vertical and horizontal relationship and threadably attached vertically to the base;

FIG. 10 is a perspective exploded view of a multiple peg block fitted with four pegs for insertion in corresponding round peg space openings located in one of the grid spaces on the base grid of the base;

FIG. 11 is a perspective view of a slotted block fitted with multiple dovetail slots, projecting dovetail block tabs, a threaded block opening and a threaded post for connection to a corresponding slotted block and joining the slotted blocks to each other and to the base;

FIG. 12 is a side view of a pair of slotted blocks illustrated in FIG. 11, more particularly illustrating the dovetail block tabs on the slotted blocks for insertion into a corresponding dovetail block slot of the adjacent slotted block;

FIG. 13 is a perspective view of a typical magnetic block fitted with an internal magnetic ball;

FIG. 14 is a side sectional view of five magnetic blocks magnetically attached in vertical and horizontal relationship, with the bottom magnetic block magnetically secured to a steel overlay mounted on the base;

DESCRIPTION OF THE PREFERRED EMBODIMENTS

Figure 1:
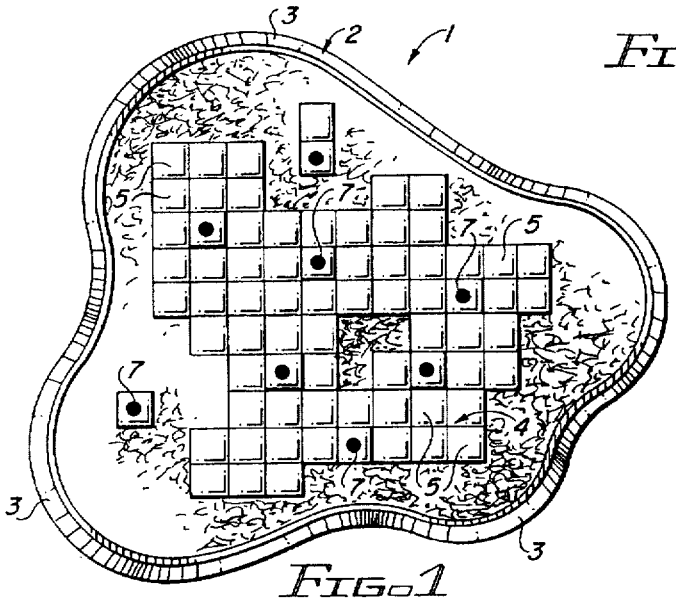
FIG. 1 is a top view of a typical base element of the three-dimensional word game of this invention.
Figure 2:
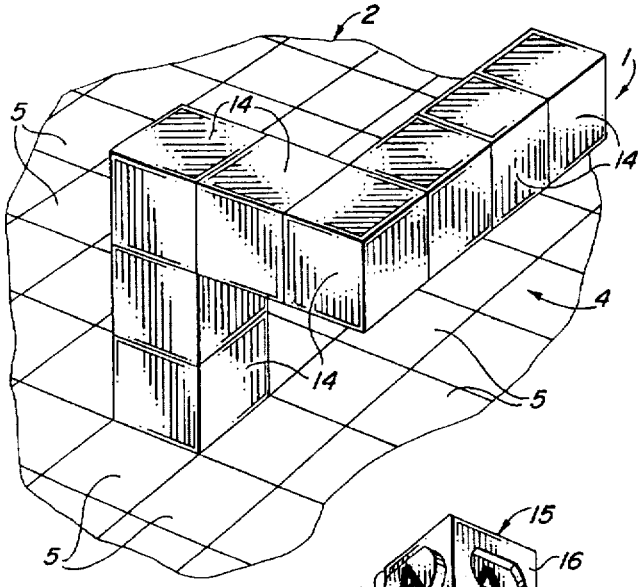
FIG. 2 is a perspective view, partially in section, of the base illustrated in FIG. 1, with multiple building blocks removably attached to the base and vertically and horizontally interconnected to facilitate playing the word game.
Figure 15:
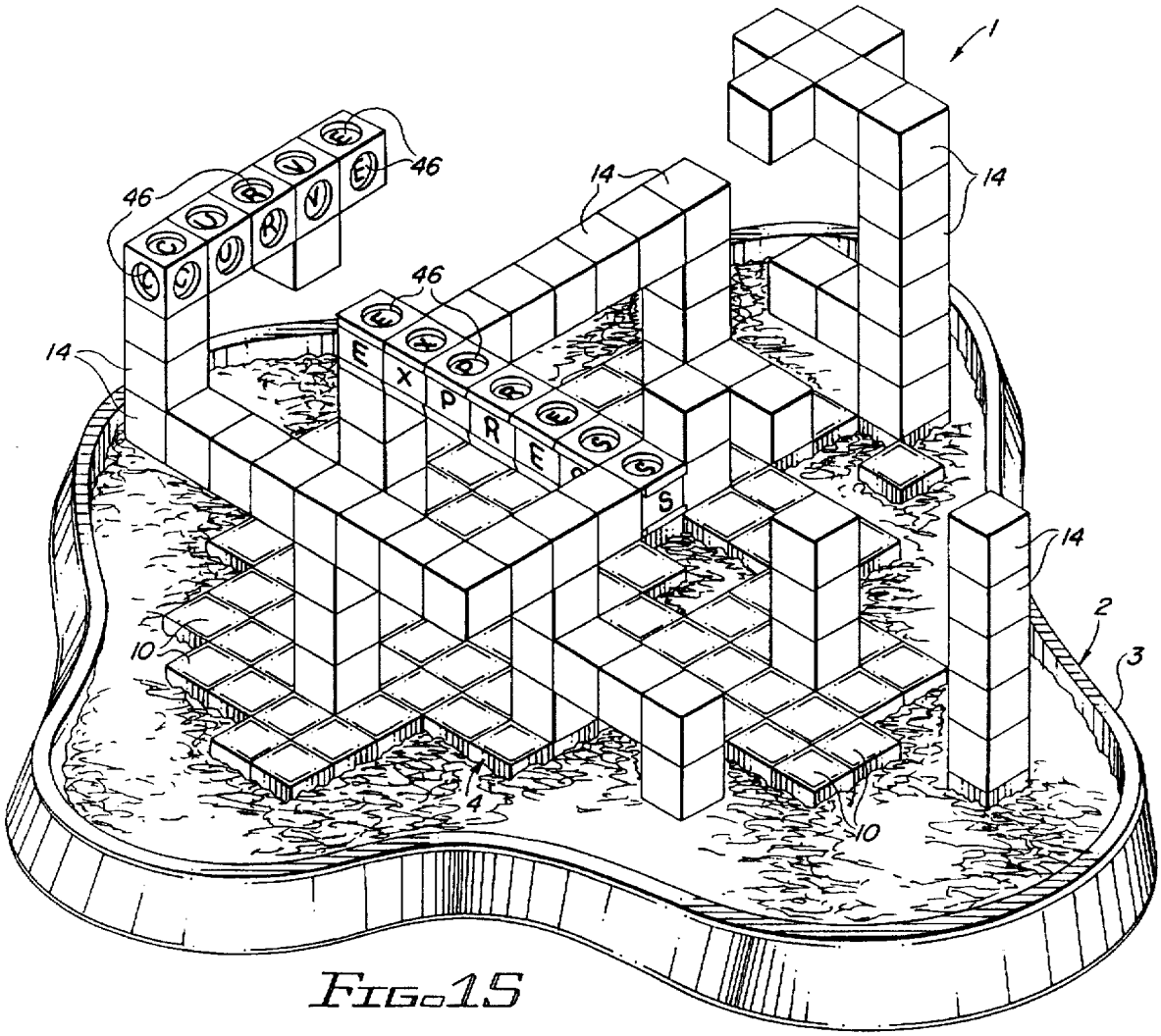
FIG. 15 is a perspective view of multiple blocks mounted vertically on a base and connected horizontally according to the insertion.
Figure 16:
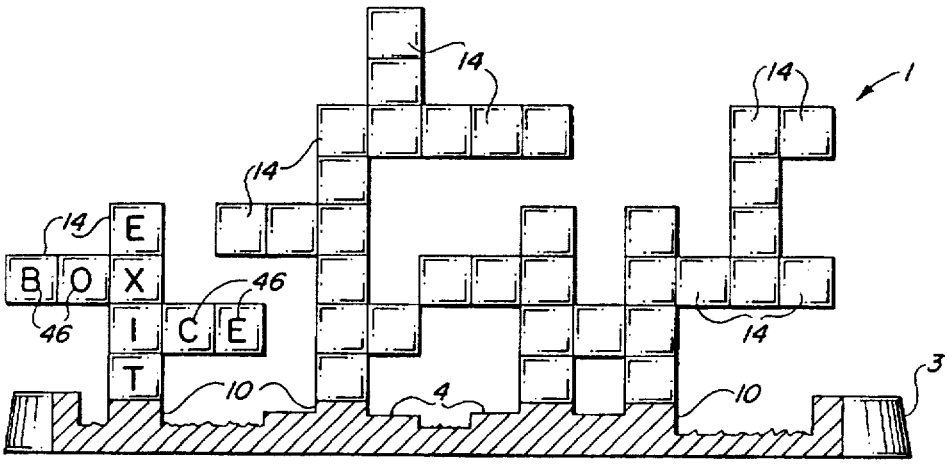
FIG. 16 is a side view of the blocks and base illustrated in FIG. 15.

Referring initially to FIGS. 1, 2, 15 and 16 of the drawings, in a preferred embodiment the three-dimensional word game of this invention is generally illustrated by reference numeral 1. The three-dimensional word game 1 is characterized by a base 2, which is illustrated as having an irregularly-shaped base border 3 with a base grid 4 thereon, the base grid 4 forming uniform grid spaces 5. It will be appreciated by those skilled in the art that the base 2 and grid spaces 5 may be shaped in any desired configuration, the irregular configuration illustrated in FIGS. 1, 2, 15 and 16 being illustrative only. As illustrated in FIGS. 2, 15 and 16, multiple building blocks 14 are interlocked or connected to each other in vertical and horizontal relationship and are removably anchored to the base grid 4 of the base 2 at selected grid spaces 5, to facilitate playing the game. The building blocks 14 are provided with various attachment or interlock mechanisms, as hereinafter described, which mechanisms can also be used to connect the bottom ones of the building blocks 14 to the base 2 at the base grid 4 on one of the correspondingly equipped grid spaces 5, illustrated in FIGS. 1 and 2. Preferred attachment or interlock mechanisms for attaching the bottom one of the building blocks 14 to the selected one of the grid spaces 5 in the base grid 4 of the base 2 will be hereinafter further described.

Figure 3:
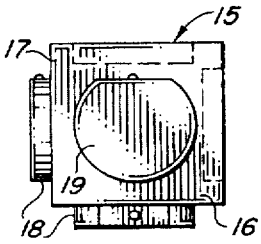
FIG. 3 is a bottom view of a truncated peg block, more particularly illustrating a recessed truncated block opening and truncated peg in the truncated peg block.
Figure 4:
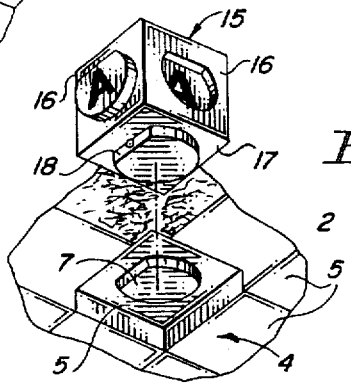
FIG. 4 is a perspective view, partially in section, of a portion of the base illustrated in FIG. 1, with truncated space openings provided in the respective grid spaces in the base and a truncated peg block illustrated in FIG. 3, having a truncated peg, more particularly illustrating removable attachment of the truncated peg block to the base by means of the truncated peg.

Referring now to FIGS. 3 and 4 of the drawings, in a first preferred embodiment of the invention the building blocks 14 are each characterized by a truncated peg block 15, which defines a cube having five block faces 16, including a top face, and a block bottom 17. The top and two other of the block faces 16 have a truncated block opening 19, while the remaining two block faces 16 and the block bottom 17 are fitted with a truncated peg 18, as illustrated in FIGS. 3 and 4. The truncated pegs 18 are designed to register with a corresponding truncated space opening 7 in each of the grid spaces 5 in the base grid 4 of the base 2, illustrated in FIG. 4. Furthermore, as illustrated in FIG. 2, multiple ones of the truncated peg blocks 15 can be assembled vertically from the base 2 by initially extending the truncated peg 18 of the bottom truncated peg block 15 into the corresponding space opening 7 as illustrated in FIG. 4, with the second and succeeding truncated pegs 18 of the corresponding stacked truncated peg blocks 15 inserted in corresponding truncated block openings 19, illustrated in FIG. 3, to stack the truncated peg blocks 15 as illustrated in FIGS. 2, 15 and 16. Additional truncated peg blocks 15 can be assembled in the same manner in a horizontal fashion as illustrated in FIGS. 2, 15 and 16 by inserting the respective truncated pegs 18 into additional truncated block openings 19 provided in the respective block faces 16, to create a configuration of truncated peg blocks 15 as illustrated by the building blocks 14 in FIGS. 2 and 15.

Figure 5:
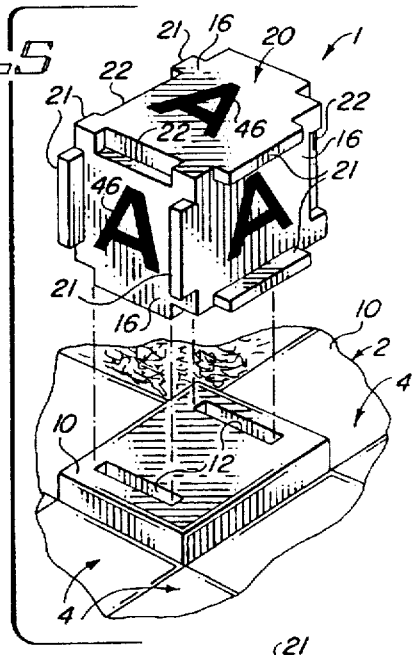
FIG. 5 is a perspective, exploded view of a portion of the base illustrated in FIG. 1, with raised, slotted square projections provided in each of the grid spaces and a snap flange block 20 positioned for removable attachment to one of the space projections.
Figure 6:
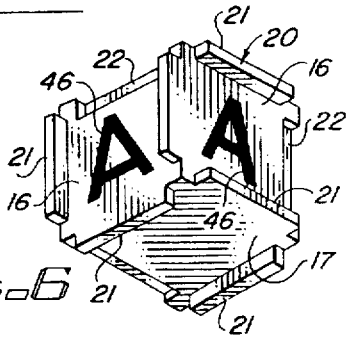
FIG. 6 is a bottom perspective view of the snap flange block illustrated in FIG. 5.
Figure 7:
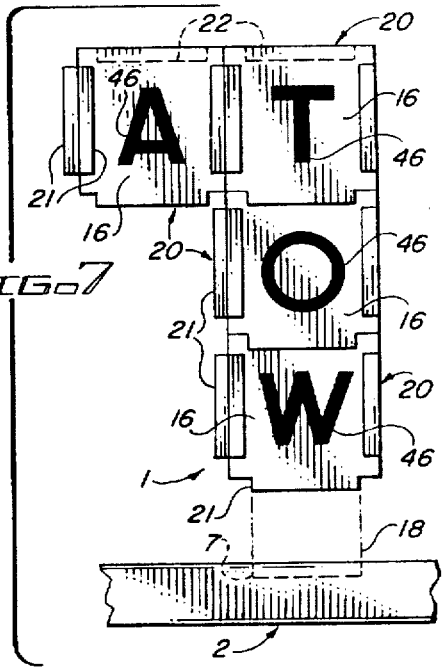
FIG. 7 is an exploded view of four interlocked snap flange blocks, the bottom snap flange block of which is fitted with an optional truncated peg, illustrated in phantom, for mounting the interlocked snap flange blocks in corresponding truncated space openings in the base, as illustrated in FIG. 4.

Referring now to FIGS. 5–7 of the drawings, snap flange blocks 20 are each illustrated, with multiple, parallel snap flanges 21 and corresponding snap flange slots 22 provided thereon to facilitate interlocking of adjacent snap flange blocks 20. This interlocking relationship is effected by intersecting the snap flanges 21 with the corresponding snap flange slots 22 on the respective snap flange blocks 20, as illustrated in FIG. 7. In a preferred embodiment of the invention the parallel snap flanges 21 of a bottom snap flange block 20 are snapped onto parallel mount slots 12 in a corresponding square projection 10 on the base 2, as illustrated in FIG. 5. Alternatively, as illustrated in FIG. 7, the snap flange block 20 can be provided with a projecting truncated peg 18 in the same manner as the truncated peg 18 illustrated in FIGS. 3 and 4 with respect to the truncated peg block 15, to facilitate mounting the snap flange block 20 to the base 2. In each case, vertical assembly of multiple snap flange blocks 20 is then effected as illustrated in FIG. 5 or FIG. 7. Accordingly, the snap flange blocks 20 can be assembled in any desired vertical and horizontal configuration, typically in the configuration illustrated by the building blocks 14 illustrated in FIGS. 2, 15 and 16, by simply engaging the respective snap flanges 21 with the corresponding snap flange slots 22 of opposing snap flange blocks 20 as illustrated in FIGS. 5–7.

Referring now to FIGS. 8 and 9 of the drawings, threaded post blocks are each generally illustrated by reference numeral 24 and include a cube having threaded posts 25 projecting from two adjacent sides of the threaded post block 24 and the bottom or third adjacent side of the threaded post block 24, with post threads 26 provided on the projecting threaded posts 25. Three internally-threaded block openings 27 are provided on the remaining three surfaces of the threaded post block 24 and internal block opening threads 28 are provided in each of the threaded block openings 27 for receiving the threaded posts 25 of adjacent threaded post block 24 and connecting the respective threaded post blocks 24 as illustrated in FIG. 9. Accordingly, the threaded post blocks 24 can be assembled as illustrated in FIG. 9 with the bottom threaded post block 24 threadably inserted in a corresponding internally-threaded space opening 8, located in the respective grid spaces 5 of the base grid 4 in the base 2, as illustrated in FIG. 8. Since the internal space opening threads 9 are provided in the threaded space openings 8, the projecting threaded posts 25 of the respective thread post block 24 can be threadably inserted in the threaded space openings 8 to secure multiple units of the threaded post block 24 in vertical orientation and facilitate horizontal attachment of the respective threaded post blocks 24, as illustrated in FIGS. 9, 15 and 16. A block opening base 29 terminates each of the internally threaded block openings 27, for purposes which will be hereinafter further described.

Referring to FIG. 10 of the drawings, in another preferred embodiment of the invention, a multiple peg block 31 is characterized by a cube provided with three adjacent block faces 16 having four block pegs 32 each, and four corresponding block peg openings 33 provided in each of the remaining three adjacent block faces 16 of the multiple peg blocks 31. Accordingly, the block pegs 32 extending from one of the block faces 16 of the multiple peg block 31 can be inserted in corresponding peg space openings 11 located in the block face 16 of a second multiple peg block 31 anchored in the peg space openings 11 of the respective grid spaces 5 of the base grid 4 and the base 2, as further illustrated in FIG. 10. It will be appreciated by those skilled in the art that an additional multiple peg block 31 can be secured to the multiple peg block 31 illustrated in FIG. 10 in stacked relationship, by registering the respective block pegs 32 with corresponding block peg openings 33. Additional peg blocks 31 can then be attached both vertically and horizontally to the adjacent multiple peg block 31 in the same manner as the threaded post blocks 24 illustrated in FIG. 9, according to the knowledge of those skilled in the art.

Referring now to FIGS. 11 and 12 of the drawings, in yet another preferred embodiment of the invention a slotted block 35 is provided, and includes two dovetail block slots 36 shaped in adjacent block faces 16 of the slotted block 35, each of the slot blocks 36 characterized by a widened slot base 37, for receiving the corresponding dovetail block tabs 38 projecting from the remaining adjacent pair of block faces 16 of the cube-shaped slotted blocks 35. Accordingly, each of the block tabs 38 can be aligned with the corresponding block slot 36 of an adjacent slotted block 35 as illustrated by the arrow in FIG. 12, to removably interlock the respective slotted blocks 35 together. In a most preferred embodiment of the invention, a threaded post (not illustrated) and a threaded block opening 27 are provided on the remaining opposite faces of the slotted blocks 35. Furthermore, some or all of the grid spaces 5 on the base grid 4 of the base 2 illustrated in FIG. 1 are provided with threaded space openings 8 in the same manner as that illustrated in FIGS. 11 and 12 on the slotted blocks 35, to facilitate engagement of the respective block slots 36 in the slotted blocks 35, and stabilizing of the slotted blocks 35 and adjacent vertical and horizontally connected slotted blocks 35, to the base 2.

Referring now to FIGS. 13 and 14 of the drawings, magnetic blocks 42 are illustrated, each of which magnetic blocks 42 is fitted with a magnetic ball 43 having at least one set of north and south poles. Accordingly, the magnetic balls 43 can be assembled as illustrated in FIG. 14, with the bottom magnetic block 42 magnetically adhering to a steel sheet 44, provided as a top laminate over the base 2 of the three-dimensional word game 1. Accordingly, the magnetic blocks 42 can be quickly and easily assembled by simply matching the attracting north poles and south poles, respectively, of the respective magnetic balls 43, to provide a desired vertical and horizontal connection between the magnetic blocks 42, as illustrated in FIG. 14.

Referring again to FIGS. 5–11, it will be appreciated by those skilled in the art that letters 46 are provided on the respective block faces 16 of the corresponding snap flange blocks 20, truncated peg blocks 15, threaded post blocks 24, multiple peg blocks 31, slotted blocks 35 and magnetic blocks 42, although for illustrative purposes, the letters are not shown on the truncated peg block 15 and magnetic block 42 variations. Accordingly, as illustrated in FIGS. 5–7, various letters are also provided on selected block faces 16 of the truncated peg blocks 15 and magnetic blocks 42 to facilitate assembling the respective truncated peg blocks 15 in the manner illustrated in FIG. 7 with respect to the snap flange blocks 20, to spell certain words. For example, as illustrated in FIG. 7, the word "AT" is spelled horizontally, while the word "TOW" is spelled vertically in the illustrated arrangement of assembled snap flange blocks 20. Furthermore, referring to FIGS. 8 and 9 of the drawings, letters are applied to the flat extended surfaces of the threaded posts 25 and the flat recessed surfaces of the block opening bases 29 of the threaded post blocks 24, for the same purpose. Accordingly, the respective threaded post blocks 24 can be assembled as illustrated in FIG. 9 to horizontally spell the word "AS" and the word "ARC", vertically.

Referring again to FIG. 10 of the drawings, the letter "A" is applied to selected flat block faces 16 of the respective multiple peg blocks 31 to facilitate assembly of the multiple peg blocks 31 on the base 2 and horizontally in the same manner as that illustrated in FIGS. 7, 9, 15 and 16, with respect to the snap flange blocks 20 and the threaded post blocks 24, respectively.

It will be appreciated that a similar arrangement of letters 46 can be applied to the flat block faces 16 of the truncated peg blocks 15 illustrated in FIGS. 3 and 4, as well as the magnetic blocks 42 illustrated in FIGS. 13 and 14, as heretofore described.

It will also be appreciated by those skilled in the art that the various embodiments of the respective lettered truncated peg blocks 15, snap flange blocks 20, threaded post blocks 24, multiple peg blocks 31, slotted blocks 35 and magnetic blocks 42 provide a wide variety of possibilities for playing the three-dimensional word game of this invention, wherein words can be spelled vertically and horizontally in a three-dimensional array above the base 2. Furthermore, the letters 46 may be applied to selected block faces 16 of the respective building blocks 14, including the threaded posts 25 and the block opening bases 29 of the threaded post blocks 24 and further including the slot bases 37 and block tabs 38 of the slotted blocks 35, such that all letters may be vertically oriented regardless of the assembling sequence of the respective building blocks 14. For example, referring again to FIG. 10 of the drawings, the letters 46 are provided on the respective block faces 16 of the multiple peg blocks 31 to facilitate spelling of words such that the letters 46 are oriented vertically regardless of the positioning of the multiple peg blocks 31 either in vertical or horizontal relationship. Similarly, referring again to FIG. 9 of the drawings, the respective threaded post blocks 24 can be oriented both vertically and horizontally as they are threadably engaged, to position the respective letters 46 in vertical relationship so as to be easily read.

It will be further appreciated by those skilled in the art that other connective devices may be used to connect the respective building blocks 14 and position the building blocks 14 into the position illustrated in FIG. 2, such that various combinations of horizontal and vertically-oriented letters may be assembled into words. For example, referring again to FIG. 11 of the drawings, the block slots 37 in the slotted block 35 are dovetail in configuration and the block tabs 38 are similarly dovetail-shaped to facilitate engagement of the respective dovetail block tabs 38 with the corresponding dovetail block slots 37 and the threaded block opening 27 and threaded post 25 on each slotted block 35 engaged in the manner as described above with respect to the respective threaded post blocks 24. Other block connections, including key connections, friction connections and the like, in non-exclusive particular, may be provided on each of the building blocks 14 and on the base 2 at each of the grid spaces 5 or selected ones of the grid spaces 5 and the base grid 4, as desired. Furthermore, combinations of the respective truncated peg blocks 15, threaded post blocks 24, multiple peg blocks 31, slotted blocks 35 and/or the magnetic blocks 42 may be used, since selected ones of the grid spaces 5 in the base grid 4 may be adapted to receive and mount separate ones of the truncated peg blocks 15, threaded post blocks 24, multiple peg blocks 31, slotted blocks 35 and magnetic block 42, as desired.

It will be further appreciated by those skilled in the art that each of the building blocks 14 may be shaped in the configuration of a rectangle or other quadrilateral and provided with variations of the truncated peg blocks 15, threaded post blocks 24, multiple peg blocks 31, slotted blocks 35 or magnetic blocks 42, as desired. For example, one or more of the block faces 16 of the cube-shaped blocks or alternative blocks may be designed to accommodate a truncated peg 18, while an adjacent block face 16 is shaped to define a threaded post 25 or a threaded block opening 27, as illustrated in FIG. 8. Still another adjacent block face 16 may accommodate the multiple block pegs 32 or block peg openings 33 as illustrated in FIG. 10 and yet another one of the block faces 16 may include a block slot 36 or a block tab 38, as illustrated in FIG. 11. Other combinations, including the magnetic ball 43 illustrated in FIGS. 13 and 14 may be used, as desired.

It will be further understood by those skilled in the art that not only letters 46 may be provided on the various block faces 16 of the respective building blocks 14, but other indicia or insigma, such as numbers or number and letter combinations may be used, to play various types of games which may be devised from the three dimensional word game 1 of this invention.

Furthermore, it will be also understood that the base 2 and base grid 4 may be constructed in a single plane, or they may be provided with two or more levels having a base grid 14 at each level, with grid spaces 5 of selected shape and size for receiving the respective variations of the building blocks 14, as described above. Moreover, while the respective grid spaces 5 in FIGS. 4, 7 and 8–10 illustrate openings of various design for receiving projecting members in the respective building blocks 14, it is understood that the reverse feature may be utilized, with the respective projecting members extending from the grid spaces 5, as illustrated in FIG. 5, to receive the respective openings provided in the building blocks 14.

In operation, the three-dimensional word game 1 of this invention is played by having each player draw a selected number of building blocks 14 of selected design at random for a common pool and one player begins the game by attaching one of his lettered building blocks 14 to a selected or designated one of the grid spaces 5 on the base grid 4 of the base 2. It is understood that the building block 14 may be characterized by a truncated peg block 15, a snap flange block 20, a threaded post block 24, a multiple peg block 31, a slotted block 35, a magnetic block 42, or a combination of any of these or other connectible blocks, as described above, depending upon the desired design of the three dimensional word game 1 and the building blocks 14. Another player is then required to add a lettered building block or blocks 14 of the same character to the first building block 14 in order to align the respective letters 46 on the building blocks 14 and spell a word. The game continues with various building blocks 14 being aligned in vertical and/or horizontal relationship as illustrated in FIGS. 2, 15 and 16, with each letter 46 assigned a numerical point value or with the assigning of a numerical point value for each spelled word, as desired.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A three-dimensional word game comprising a game board; a grid provided on said game board, said grid defining a plurality of grid spaces; a plurality of blocks, each of said blocks having six block faces; male coupling means and female coupling means provided on selected ones of said block faces on selected ones of said blocks for connecting said blocks; game indicia provided on at least three of said block faces; and anchor means provided in selected ones of said grid spaces for selectively receiving said male coupling means and said female coupling means respectively and anchoring selected ones of said blocks to said game board, whereby said blocks are stacked vertically from said game board and said blocks are selectively extended horizontally above said game board to organize said game indicia in a selected manner, responsive to connecting of said blocks by said male coupling means and said female coupling means.

2. The three-dimensional word game of claim 1 wherein said anchor means comprises a truncated board opening provided in said selected ones of said grid spaces and said male coupling means comprises a truncated peg for removably registering with said truncated board opening and removably mounting selected ones of said blocks on said selected ones of said grid spaces, respectively.

3. The three-dimensional word game of claim 1 wherein said anchor means comprises a truncated peg extending from said selected ones of said grid spaces and said female coupling means comprises a truncated opening for removably receiving said truncated peg and removably mounting selected ones of said blocks on said selected ones of said grid spaces, respectively.

4. The three-dimensional word game of claim 1 wherein said anchor means comprises a pair of substantially parallel slots provided in said selected ones of said grid spaces and said male coupling means comprises a pair of snap flanges for engaging said slots and removably mounting selected ones of said blocks on said selected ones of said grid spaces, respectively.

5. The three-dimensional word game of claim 1 wherein said anchor means comprises an internally-threaded board opening provided in said selected ones of said grid spaces and said male coupling means comprises a threaded post for threadably engaging said internally-threaded board opening and removably mounting selected ones of said blocks on said selected ones of said grid spaces, respectively.

6. The three-dimensional word game of claim 1 wherein said anchor means comprises a threaded post extending from said selected ones of said grid spaces and said female coupling means comprises an internally-threaded opening for threadably receiving said threaded post and removably mounting selected ones of said blocks on said selected ones of said grid spaces, respectively.

7. The three-dimensional word game of claim 1 wherein said anchor means comprises at least two pegs provided in spaced, substantially parallel, upward-standing relationship with respect to each other on said selected ones of said grid spaces and said female coupling means comprises at least two openings spaced from each other for removably receiving said pegs and removably mounting selected ones of said blocks on said selected ones of said grid spaces, respectively.

8. The three-dimensional word game of claim 1 wherein said anchor means comprises at least two board openings provided in spaced relationship with respect to each other in said selected ones of said grid spaces and said male coupling means comprises at least two pegs spaced from each other in substantially parallel relationship for removably engaging said board openings and removably mounting selected ones of said blocks on said selected ones of said grid spaces, respectively.

9. The three-dimensional word game of claim 1 wherein said anchor means comprises a dovetail board slot provided in said selected ones of said grid spaces and said male coupling means comprises a dovetail tab for removably slidably engaging said board slot and removably mounting selected ones of said blocks on said selected ones of said grid spaces, respectively.

10. The three-dimensional word game of claim 1 wherein said anchor means comprises a dovetail tab provided on selected ones of said grid spaces and said female coupling means comprises a dovetail slot for removably slidably receiving said dovetail tab and removably mounting selected ones of said blocks on said selected ones of said grid spaces, respectively.

11. A three-dimensional word game comprising a game board; a grid provided in said game board, said grid defining a plurality of grid spaces; a plurality of blocks, each of said blocks having six block faces of substantially equal dimension to define a cube; an internally-threaded block opening provided in each of a first three of said block faces lying adjacent to each other in each of said blocks; a threaded post extending from each of the remaining three of said block faces lying adjacent to each other; a selected letter of the alphabet provided in selected ones of said internally-threaded block opening and on selected ones of said threaded post; and anchor means provided on selected ones of said grid spaces for selectively and removably receiving said threaded posts and engaging said internally-threaded block openings, respectively, and removably mounting said blocks on said game board.

12. The three-dimensional word game of claim 11 wherein said anchor means comprises an internally-threaded board opening for threadably receiving said threaded post and securing selected ones of said blocks on said grid spaces, respectively.

13. The three-dimensional word game of claim 11 wherein said anchor means comprises a threaded board post extending from said grid spaces for threadably engaging said internally-threaded block opening and securing selected ones of said blocks on said grid spaces, respectively.

14. A three-dimensional word game comprising a game board; a grid provided in said game board, said grid defining a plurality of grid spaces; a plurality of blocks, each of said blocks having six block faces of substantially equal dimension to define a cube; a dovetail slot provided in each of a first pair of said block faces lying adjacent to each other in each of said blocks; a dovetail tab provided on each of a second pair of said block faces lying adjacent to each other; male coupling means provided on one of said block faces and female coupling means provided on one of said block faces opposite said male coupling means; a selected letter of the alphabet provided in selected ones of said block faces; and anchor means provided on selected ones of said grid spaces for selectively and removably receiving said male coupling means pin and said female coupling means and removably mounting said blocks on said game board.

15. The three-dimensional word game of claim 14 wherein said anchor means comprises an internally-threaded board opening provided in said grid spaces and said male coupling means comprises a threaded post for threadably engaging said internally-threaded board opening and removably mounting selected ones of said blocks on selected ones of said grid spaces, respectively.

16. The three-dimensional word game of claim 14 wherein said anchor means comprises a threaded post extending from said selected ones of said grid spaces and said female coupling means comprises an internally-threaded opening for threadably receiving said threaded post and removably mounting selected ones of said blocks on said selected ones of said grid spaces, respectively.

17. The three-dimensional word game of claim 14 wherein said anchor means comprises a truncated peg extending from said selected ones of said grid spaces and said female coupling means comprises a truncated opening for removably receiving said truncated peg and removably mounting selected ones of said blocks on said selected ones of said grid spaces, respectively.

18. The three-dimensional word game of claim 14 wherein said anchor means comprises a truncated board opening provided in said selected ones of said grid spaces and said male coupling means comprises a truncated peg for removably registering with said truncated board opening and removably mounting selected ones of said blocks on said selected ones of said grid spaces, respectively.

19. The three-dimensional word game of claim 14 wherein said anchor means comprises a pair of substantially parallel slots provided in said selected ones of said grid spaces and said male coupling means comprises a pair of snap flanges for engaging said slots and removably mounting selected ones of said blocks on said selected ones of said grid spaces, respectively.

* * * * *